US005740599A

United States Patent [19]

Chang

[11] Patent Number: 5,740,599

[45] Date of Patent: Apr. 21, 1998

[54] METHOD OF MAKING A CLEANING SCRUBBER

[76] Inventor: James Chang, No. 82-2, Wung Yuann Rd., Ta-Tao Li, Pei-Dou Cheng, Chang Hau Hsien, Taiwan

[21] Appl. No.: 580,971

[22] Filed: Jan. 3, 1996

[51] Int. Cl.[6] ..... B23P 11/02

[52] U.S. Cl. ..... 29/446; 29/235; 300/21

[58] Field of Search ..... 29/446, 452, 235; 300/21

[56] References Cited

U.S. PATENT DOCUMENTS

| | | | |
|---|---|---|---|
| 4,168,863 | 9/1979 | Hatcher | 300/21 |
| 4,206,948 | 6/1980 | Shimizu | 300/21 |
| 5,144,744 | 9/1992 | Campagnoli | 29/446 |

*Primary Examiner*—P. W. Echols

*Attorney, Agent, or Firm*—Browdy and Neimark

[57] ABSTRACT

A method of making a cleaning scrubber comprising a step of preparing an elastic and reticulate tube, which is fitted over a locating set of a molding tool such that the tube is forced to expand and that the periphery of the tube is pleated. The expanded and pleated tube is then fastened with two resilient cords such that two fastened areas are opposite in location to each other and that two resilient cords form a ring located between the inner and the outer sides of the tube. Finally, the tube is removed from the molding foot and released to allow the periphery of the tube to expand along the cords serving as axes, so as to form a spherical cleaning scrubber.

5 Claims, 2 Drawing Sheets

METHOD OF MAKING A CLEANING SCRUBBER

FIELD OF THE INVENTION

The present invention relates generally to a method of making a cleaning tool, and more particularly to a method of making an expandable cleaning scrubber.

BACKGROUND OF THE INVENTION

The U.S. Pat. No. 5,144,744 discloses a method of making an cleaning scrubber. The method comprises four support rods, which are separated from one another by an appropriate distance and are intended to support two tubes having a reticulate periphery. The tubes are compressed axially to form four elongated structures. The four elongated structures are fastened around the midsegments thereof with a cord. Thereafter, the tubes are removed from the support rods so as to become expanded, with the cord serving as an axis.

The prior art method described above is defective in design in that the fastened portion of the cleaning scrubber so made is rigid and can therefore cause a discomfort on the skin making contact with the scrubber. In addition, the tubes are fastened at an interval of 180 degrees, thereby causing the outer portions of the tubes to become curved excessively. As a result, the tubes are less elastic. The cleaning scrubber so made has a poor cleaning effect.

SUMMARY OF THE INVENTION

It is therefore the primary objective of the present invention to provide a method of making a cleaning scrubber having an excellent cleaning effect.

The foregoing objective and the feature of the present invention will be readily understood upon a thoughtful deliberation of the detailed description of the present invention in conjunction with the accompanying drawings.

DETAILED DESCRIPTION OF THE INVENTION

Figure 1:
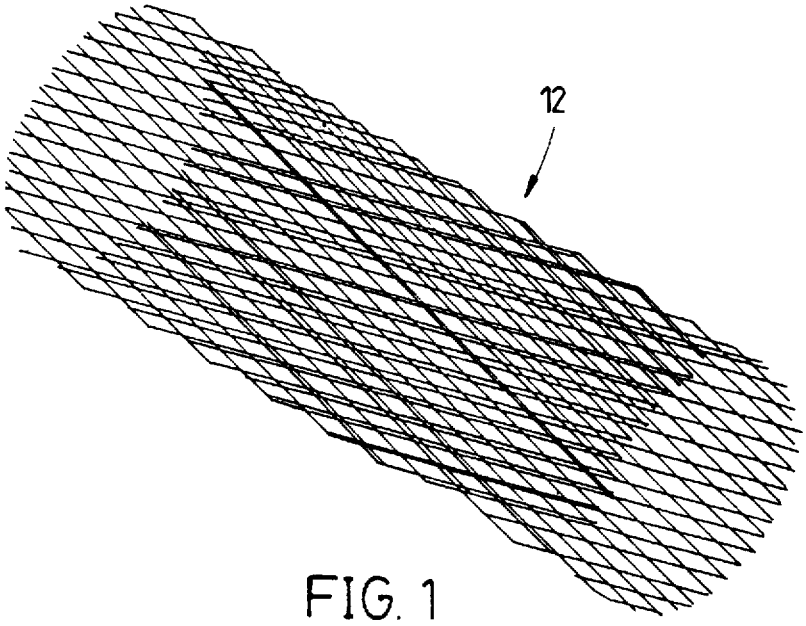
FIG. 1 shows a perspective view of a resilient tube of a reticulate construction of a first preferred embodiment of the present invention.
Figure 2:
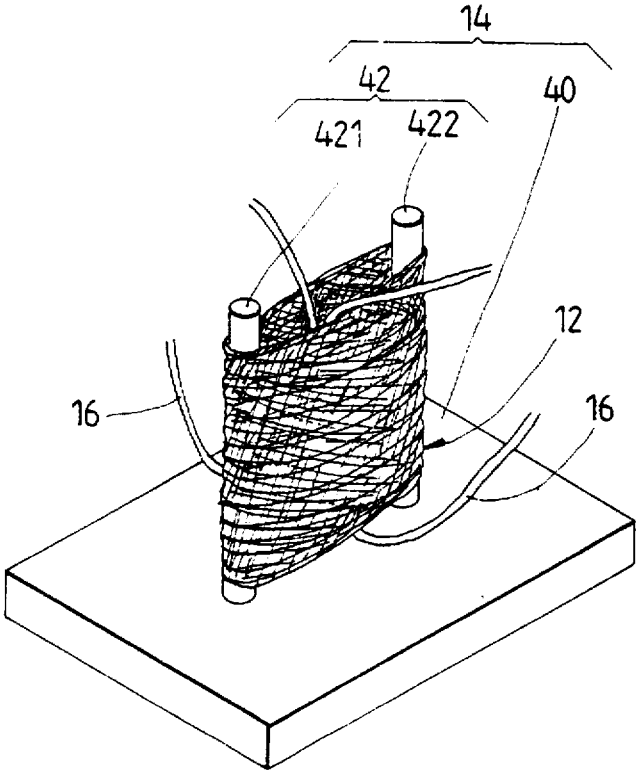
FIG. 2 shows a schematic view of the first preferred embodiment of the present invention.
Figure 4:
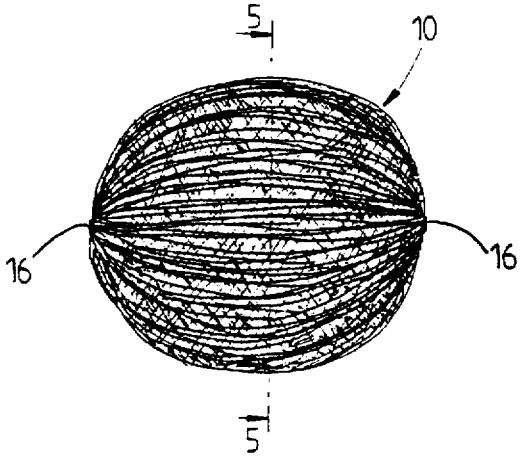
FIG. 4 shows a perspective view of a cleaning scrubber made by the method of the present invention.
Figure 5:
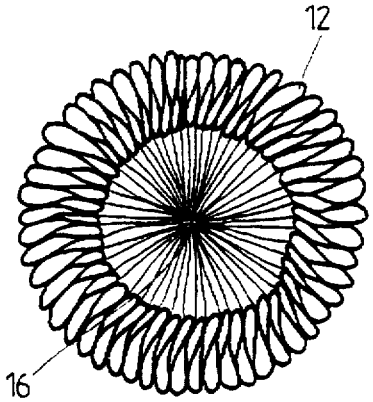
FIG. 5 shows a sectional view of a portion taken in the direction indicated by the line 5—5 as shown in FIG. 4.

As illustrated in FIGS. 1 and 2, the method embodied in the present invention for making a cleaning scrubber 10 comprises the steps of:

(a) preparing an elastic and reticulate tube 12 of a plastic material as shown in FIG.1;

(b) preparing a molding tool 14 having a flat base 40 and a locating set 42 extending upwardly from the flat base 40 and having a first support rod 421 and a second support rod 422, which are parallel to each other at an interval greater than the inner diameter of the tube 12 as shown in FIG.2;

(c) fitting the tube 12 over the locating set 42 such that the tube 12 is caused to expand by the first and the second support rods 421 and 422 also as shown in FIG.2;

(d) tightening two elastic cords 16 around the tube 12 at an interval of 180 degrees such that the elastic cords 16 form a ring located between the inner and outer surfaces of the tube 12 to compress the tube axially where the two elastic cords 16 are fastened and produce pleats on the periphery of the said tube;

(e) removing from the locating set 42 the tube 12 along with the cords 16; and (f) permitting the tube 12 to expand around an axis between the two tightened elastic cords 16 such that a cleaning scrubber 10 of a spherical construction is made, as shown in FIG. 4.

The cleaning scrubber 10 so made is unique in construction in that the cords 16 are fastened and tightened around both inner and outer surfaces of the tube 12, and that the fastened portions of the tube 12 do not become so rigid as to cause a cleaning discomfort to the skin making contact with the scrubber 10 of the present invention. Moreover, the distance between the two fastened tightened portions of the cords 16 can be equal to the inner diameter of the tube 12, thereby allowing the peripheries of the tube 12 to more freely expand. As a result, the scrubber 10 made by the method of the present invention is provided with an excellent cleaning effect.

Figure 3:
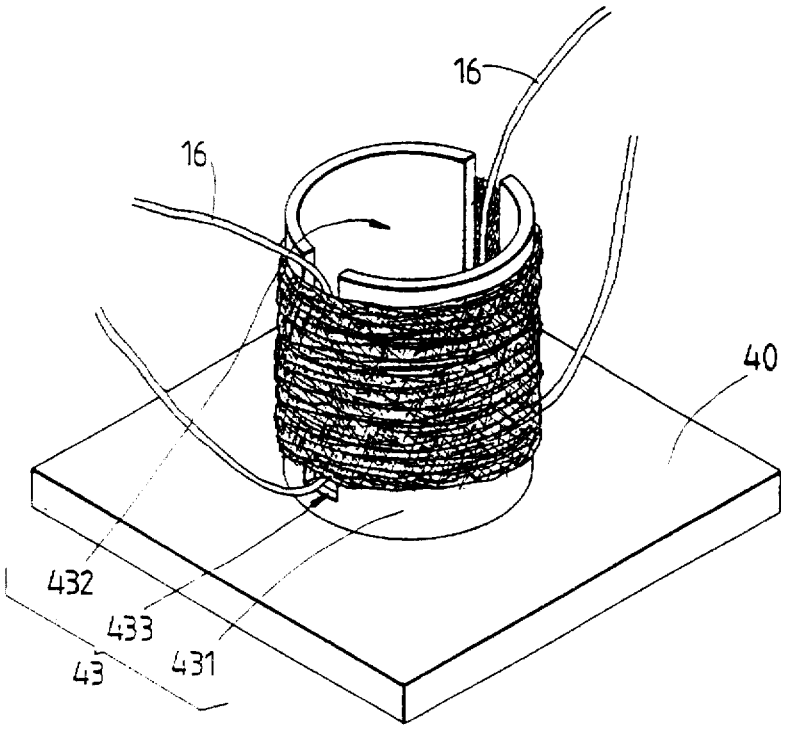
FIG. 3 shows a schematic view of a second preferred embodiment of the present invention.

As shown in FIG. 3, the second preferred embodiment of the present invention comprises a locating set 43 which has a tubular body 431 of an appropriate length, and two slots 433 having an open upper end 432. The slots 433 are separated at an interval of 180 degrees and are located along the wall of the tubular body 431.

In the process of making the scrubber 10, the reticulate tube 12 is fitted over the locating set 43 such that the lower end of the tube 12 remains above the bottom ends of the slots 433 so as to allow two cords 16 to fasten at an interval of 180 degrees the corresponding portions of the tube 12 from the bottom ends of the slots 433 to extend between the inner and the outer edges of the tubular body 431.

What is claimed is:

1. A method of making a cleaning scrubber, said method comprising the steps of:

(a) preparing an elastic and reticulate tube of a predetermined length;

(b) expanding said elastic and reticulate tube over two spaced apart support elements fixed on a molding tool;

(c) inserting two resilient cords between said two spaced apart support elements at an interval of 180 degrees such that said resilient cords form a ring located between an inner side and an outer side of said tube;

(d) tightening said two resilient cords to compress the tube axially and produce pleats on a periphery of said tube;

(e) removing the compressed tube from the two spaced apart support elements; and (f) releasing said tube to allow said periphery of said tube to expand around an axis between said two tightened resilient cords.

2. The method as defined in claim 1, wherein said molding tool comprises a base and a locating set extending from an upper side of said base for said elastic and reticulate tube to be fitted over said locating set.

3. The method as defined in claim 2, wherein said locating set is composed of at least two rod-shaped objects extending in a parallel manner.

4. The method as defined in claim 2, wherein said locating set has a tubular body having an upper open end and two slots located in a wall of said tubular body.

5. The method as defined in claim 4, wherein said two slots are opposite in location to each other.

* * * * *